US012420161B2

(12) United States Patent
Han

(10) Patent No.: US 12,420,161 B2
(45) Date of Patent: Sep. 23, 2025

(54) GOLF SWING TRAINING APPARATUS

(71) Applicant: GOLFZON Co., Ltd., Seoul (KR)

(72) Inventor: Noori Han, Seoul (KR)

(73) Assignee: GOLFZON Co., Ltd., Seoul (KR)

( * ) Notice: Subject to any disclaimer, the term of this patent is extended or adjusted under 35 U.S.C. 154(b) by 318 days.

(21) Appl. No.: 18/305,499

(22) Filed: Apr. 24, 2023

(65) Prior Publication Data

US 2023/0256315 A1 Aug. 17, 2023

Related U.S. Application Data

(63) Continuation of application No. PCT/KR2021/012868, filed on Sep. 17, 2021.

(30) Foreign Application Priority Data

Nov. 13, 2020 (KR) ..... 10-2020-0152336

(51) Int. Cl.
*A63B 69/36* (2006.01)

(52) U.S. Cl.
CPC ..... *A63B 69/3632* (2013.01); *A63B 2209/08* (2013.01)

(58) Field of Classification Search
CPC ..... A63B 69/3632; A63B 2209/08; A63B 15/005; A63B 2071/0655; A63B 69/3623; A63B 69/3638; A63B 21/00196; A63B 24/0021; A63B 69/3614; A63B 69/3655; A63B 2024/0028
USPC ..... 473/203–206, 219–226, 231–234, 256, 473/257, 266, 457
See application file for complete search history.

(56) References Cited

U.S. PATENT DOCUMENTS 2,532,646 A * 12/1950 Severin ..... A63F 7/2472 473/251
4,027,886 A * 6/1977 Katsube ..... A63B 69/3632 273/456
4,295,832 A * 10/1981 Karell ..... G09B 1/08 434/168
6,955,610 B1 * 10/2005 Czaja ..... A63B 60/04 473/226

(Continued)

FOREIGN PATENT DOCUMENTS

CN 205612998 U 10/2016
JP 2001-009077 A 1/2001

(Continued)

*Primary Examiner* — Nini F Legesse
(74) *Attorney, Agent, or Firm* — Sughrue Mion, PLLC

(57) ABSTRACT

Proposed herein is a golf swing training apparatus for providing sensations of hitting for golf swing practice. The golf swing training apparatus includes: a shaft body formed to a predetermined length, and having a grip; an impact ball coupled to be movable along the longitudinal direction of the shaft body, and configured to provide weight; a ball rail formed along the longitudinal direction of the shaft body, configured to provide a movement path, and provided with a stopper; one or more magnets installed in the impact ball, and configured to provide a magnetic force; and a magnet fixing part configured to face the magnet while forming a metal region, and also configured to hold the impact ball through the action of attraction with the magnet and to provide an attractive force having a different strength depending on the position of the impact ball.

10 Claims, 7 Drawing Sheets

(56) References Cited

U.S. PATENT DOCUMENTS

| | | | | |
|---|---|---|---|---|
| 7,798,910 | B2 * | 9/2010 | Leadbetter ..... | A63B 69/3614 473/215 |
| 9,687,718 | B1 * | 6/2017 | Sorenson ..... | A63B 69/0091 |
| 2011/0300963 | A1 | 12/2011 | Kim | |
| 2017/0291090 | A1 | 10/2017 | Wang | |

FOREIGN PATENT DOCUMENTS

| | | | |
|---|---|---|---|
| JP | 2012-517878 | A | 8/2012 |
| JP | 2020-18672 | A | 2/2020 |
| KR | 10-0832098 | B1 | 5/2008 |
| KR | 10-2010-0082253 | A | 7/2010 |
| KR | 10-1115633 | B1 | 1/2012 |
| KR | 20-2014-0000944 | U | 2/2014 |
| KR | 10-1507569 | B1 | 4/2015 |
| KR | 20-2015-0001269 | U | 4/2015 |
| WO | 2018/118926 | A1 | 6/2018 |

* cited by examiner

GOLF SWING TRAINING APPARATUS

TECHNICAL FIELD

The embodiments disclosed herein relate to a golf swing training apparatus, and more particularly, to a golf swing training apparatus capable of providing sensations of hitting through a weight element that is moved by the centrifugal force caused by a swing.

BACKGROUND ART

Generally, golf is an exercise in which a golfer hits a golf ball and puts it in a hole at a desired place, and has recently become a popular sport.

In this case, the goal of a golf swing is to accurately fly a golf ball over a desired distance in a desired direction while moving the head of a golf club along a specific trajectory.

Such golf swings can prevent miss shots only when they are provided with an appropriate rhythm, and golf balls can be flown away only when the fastest speed is obtained upon impact.

Accordingly, there have been proposed practice devices for practicing golf swings.

As related prior art, there is a 'golf swing practice bat' disclosed in Korean Utility Model Registration Application Publication No. 20-2015-0001269.

More specifically, the prior art proposes a practice bat that includes a shaft including a rod-shaped shaft body and a grip part formed at one end of the shaft body so that a user can grip it, a weight element coupled to the other end of the shaft body, a fixing ring fitted and coupled into the shaft body, a movable part including a movable element slidably fitted over the shaft body between the fixing ring and the weight element, a magnet provided in the fixing ring, and a contact separation part made of a metallic material, provided in the movable element, and configured to come into contact with the fixing ring by the magnet and be separated from the fixing ring by a centrifugal force during a swing.

This prior art is a technology in which the movable element is separated from the fixing ring and moved to the weight element during the swing of the shaft, thereby providing the timing of impact.

However, the prior art described above has a configuration in which the movable element is fixed only in a state of being in close contact with the fixing ring through the magnet, and thus the fixed position of the movable element cannot be adjusted, so that there is a problem in that the prior art cannot provide a variety of sensations of weight.

Therefore, there is a demand for technology for overcoming the above-described problems.

Meanwhile, the above-described background technology corresponds to technical information that has been possessed by the present inventor in order to contrive the present invention or that has been acquired in the process of contriving the present invention, and can not necessarily be regarded as well-known technology that had been known to the public prior to the filing of the present invention.

DISCLOSURE

Technical Problem

An object of the embodiments disclosed herein is to provide a golf swing training apparatus capable of providing a variety of sensations of weight by allowing the initial position of an impact ball to be adjusted while providing a sensation of hitting through the weight of the impact ball that is moved by the centrifugal force caused by a swing.

More specifically, an object of the embodiments disclosed herein is to provide a golf swing training apparatus capable of adjusting the initial position of an impact ball while fixing the impact ball to a metal region formed on a shaft body through the magnetic force of a magnet.

In particular, an object of the embodiments disclosed herein is to provide a golf swing training apparatus capable of providing a variety of sensations of weight during swing practice by providing attractive forces having different strengths caused by the magnetic force according to the initial position of the impact ball.

In addition, an object of the embodiments disclosed herein is to provide a golf swing training apparatus capable of adding weight to an impact ball that provides weight.

Technical Solution

As a technical solution for overcoming the above-described technical problem, according to an embodiment, there is provided a golf swing training apparatus for providing sensations of hitting for golf swing practice, the golf swing training apparatus including: a shaft body formed to a predetermined length, and having a grip formed at one of both ends thereof in the longitudinal direction thereof; an impact ball coupled to be movable along the longitudinal direction of the shaft body, and configured to provide weight for the generation of a sensation of hitting while being moved in the direction opposite to that of the grip by the centrifugal force caused by the swing of the shaft body; a ball rail formed in a part of the shaft body opposite to the grip along the longitudinal direction, configured to provide a movement path for the impact ball, and provided with a stopper at an end thereof to provide a stop portion for the impact ball; one or more magnets installed in the impact ball, and configured to provide a magnetic force; and a magnet fixing part configured to face the magnet while forming a metal region made of a metallic material in a portion of one of both ends of the ball rail opposite to the stopper in the longitudinal direction, and also configured to hold the impact ball through the action of attraction with the magnet and to provide an attractive force having a different strength depending on the position of the impact ball.

Advantageous Effects

According to any one of the above-described technical solutions, there may be proposed the golf swing training apparatus capable of providing a variety of sensations of weight during swing practice because the strength of the attractive force caused by the magnetic force may be adjusted by adjusting the initial position of the impact ball while the impact ball, which provides a sensation of hitting through weight while being moved by the centrifugal force caused by a swing, is fixed to the metal region formed on the ball rail through the magnetic force of the magnet.

In particular, according to any one of the above-described technical solutions, there may be proposed the golf swing training apparatus capable of providing various swing practice conditions through a variety of sensations of weight by providing attractive forces having different strengths, caused by the magnetic force of the magnet through the configuration of the magnet fixing part, depending on the position of the impact ball.

More specifically, the first fixing part and the second fixing part constituting the magnet fixing part are formed to have different outer diameters and face the magnets installed in the impact ball, so that attractive forces having different strengths may be provided, and the first impact ball and the second impact ball constituting the impact ball are formed to have different inner diameters and space the magnets apart from the fixing part at different intervals, so that attractive forces having different strengths may be provided.

In addition, according to any one of the above-described technical solutions, there may be proposed the golf swing training apparatus capable of adjusting weight by detaching the second impact ball as necessary because the first impact ball and the second impact ball are formed to have different weights and are coupled through the configuration of the ball fixing part.

In addition, according to any one of the above-described technical solutions, there may be proposed the golf swing training apparatus capable of obtaining data on swing practice by providing information such as the swing trajectory of the shaft body through the configuration of the IR sensing unit.

The effects that can be obtained by the embodiments disclosed herein are not limited to the effects described above, and other effects not described above will be clearly understood by those of ordinary skill in the art to which the present invention pertains from the following description.

MODE FOR INVENTION

Figure 1:
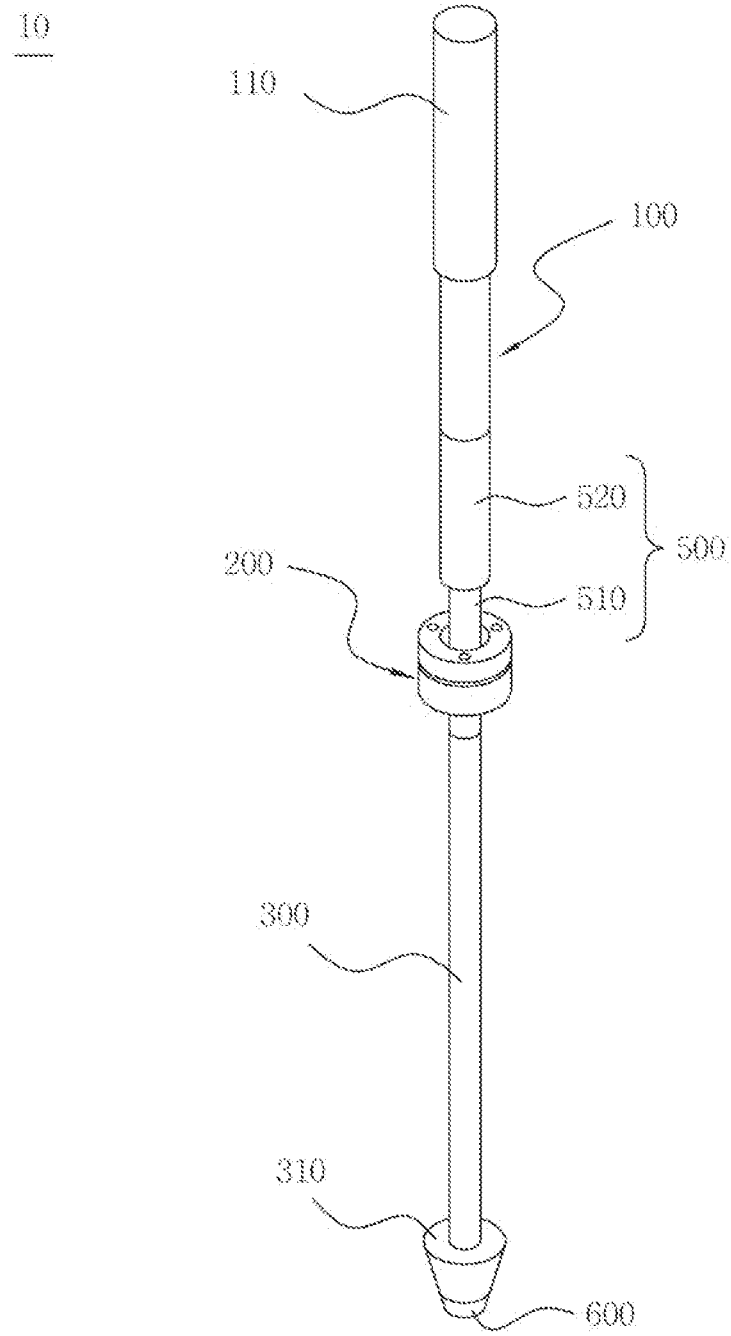
FIG. 1 is a diagram showing the configuration of a golf swing training apparatus according to an embodiment.

Various embodiments will be described in detail below with reference to the accompanying drawings. The following embodiments may be modified to various different forms and then practiced. In order to more clearly illustrate features of the embodiments, detailed descriptions of items that are well known to those of ordinary skill in the art to which the following embodiments pertain will be omitted. Furthermore, in the drawings, portions unrelated to descriptions of the embodiments will be omitted. Throughout the specification, like reference symbols will be assigned to like portions.

Throughout the specification, when one component is described as being "connected" to another component, this includes not only a case where the one component is "directly connected" to the other component but also a case where the one component is "connected to the other component with a third component disposed therebetween." Furthermore, when one portion is described as "including" one component, this does not mean that the portion does not exclude another component but means that the portion may further include another component, unless explicitly described to the contrary.

The embodiments of the present invention will be described in detail below with reference to the accompanying drawings.

Figure 2:
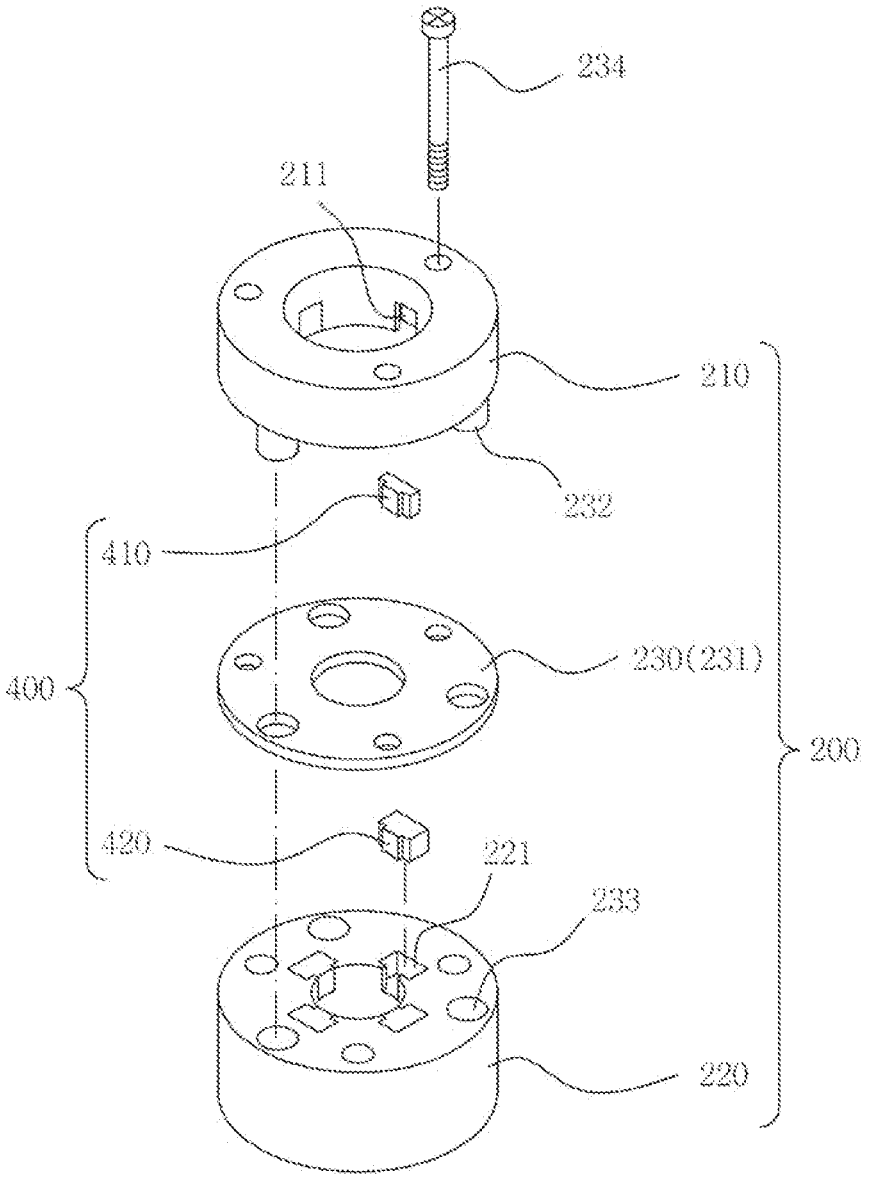
FIG. 2 is an exploded perspective view showing the impact ball of the golf swing training apparatus according to the embodiment.
Figure 3:
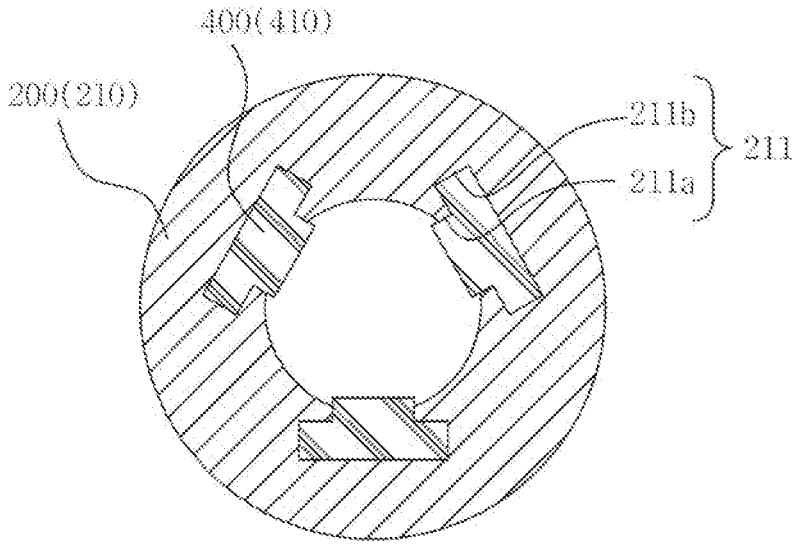
FIG. 3 is a cross-sectional view showing a first impact ball constituting a part of the impact ball of the golf swing training apparatus according to the embodiment.
Figure 4:
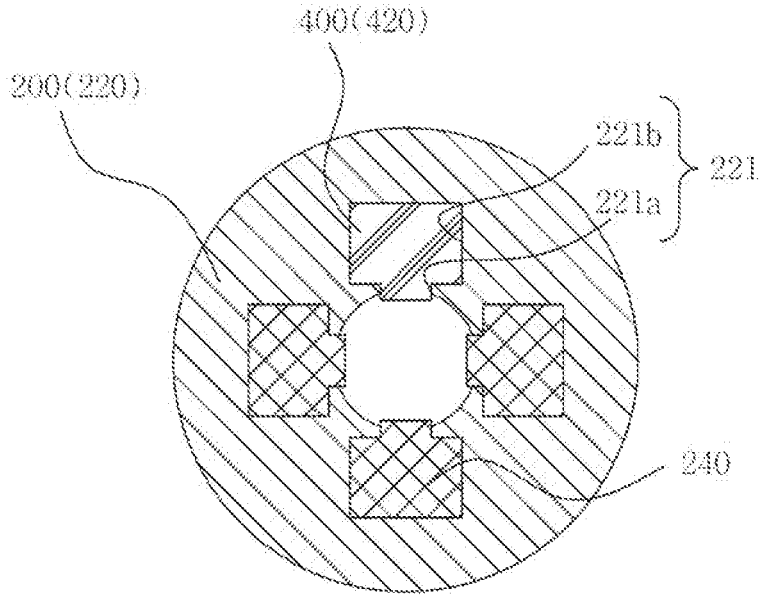
FIG. 4 is a cross-sectional view showing a second impact ball constituting a part of the impact ball of the golf swing training apparatus according to the embodiment.
Figure 5:
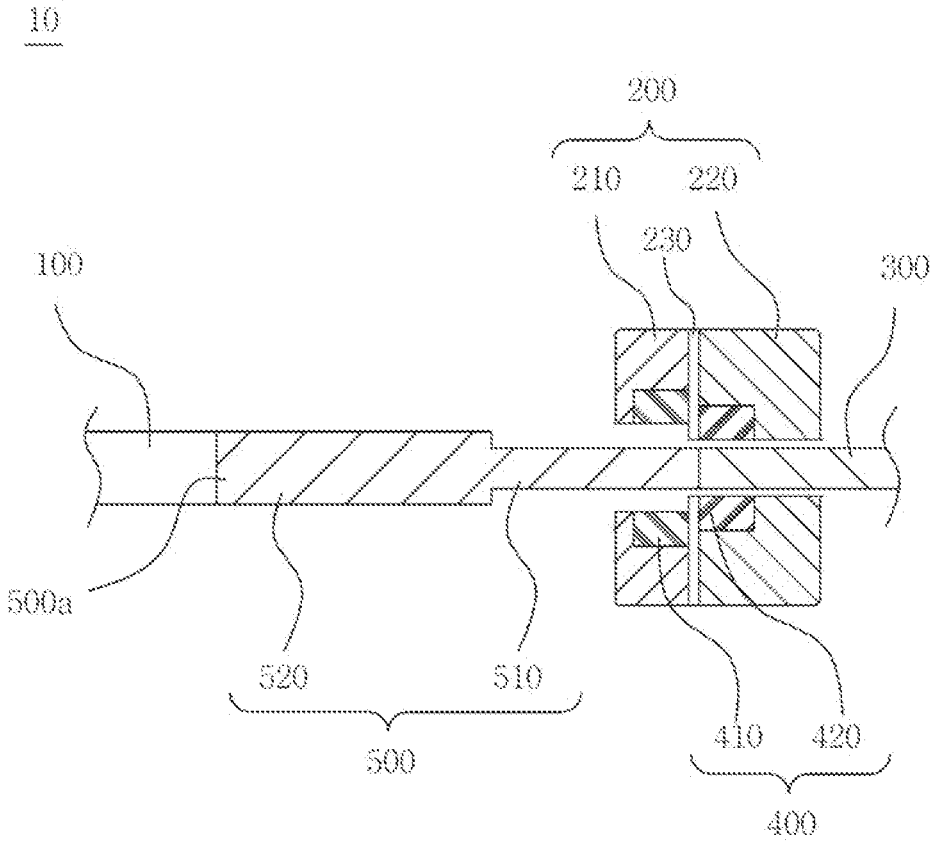
FIGS. 5 to 7 are longitudinal sectional views showing states in which the impact ball of the golf swing training apparatus according to the embodiment is fixed to a magnet fixing part in a stepwise manner.
Figure 6:
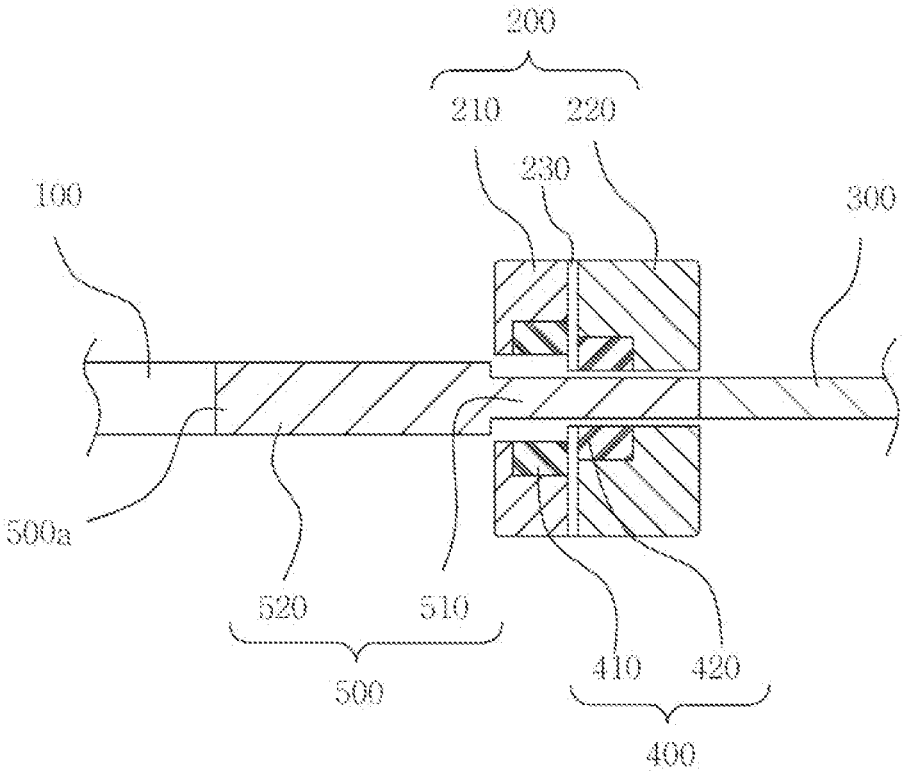
Figure 7:
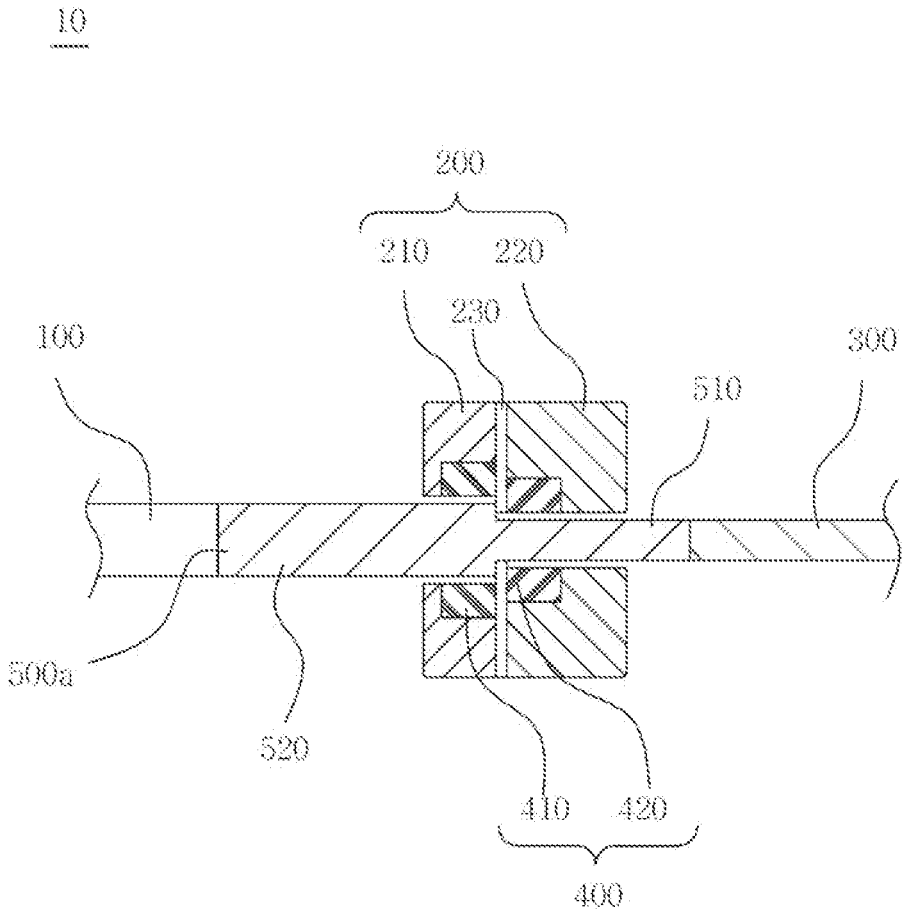

FIG. 1 is a diagram showing the configuration of a golf swing training apparatus according to an embodiment, and FIG. 2 is an exploded perspective view showing the impact ball of the golf swing training apparatus according to the embodiment. Furthermore, FIG. 3 is a cross-sectional view showing a first impact ball constituting a part of the impact ball of the golf swing training apparatus according to the embodiment, FIG. 4 is a cross-sectional view showing a second impact ball constituting a part of the impact ball of the golf swing training apparatus according to the embodiment, and FIGS. 5 to 7 are longitudinal sectional views showing states in which the impact ball of the golf swing training apparatus according to the embodiment is fixed to a magnet fixing part in a stepwise manner.

A golf swing training apparatus 10 according to an embodiment is a device for providing sensations of hitting through a moving weight element during swing practice.

As shown in FIGS. 1 and 2, this golf swing training apparatus 10 may be configured to include a shaft body 100, an impact ball 200, a ball rail 300, one or more magnets 400, and a magnet fixing part 500.

The shaft body 100 is a component that is swung while being held in a user's hand for swing practice. The shaft body 100 may be formed to a predetermined length while forming a bar shape corresponding to a conventional golf club. A grip 110 is formed at the upper one of both ends in the longitudinal direction thereof and may be gripped by a user.

In addition, the ball rail 300 may be formed in the shaft body 100 to provide a movement path for the impact ball 200 to be described later.

More specifically, the ball rail 300 uniformly extends in a portion of the shaft body 100 on the side opposite to the grip 110 while forming a predetermined outer diameter, thereby providing a movement path for the impact ball 200 to be described later.

In this case, a stopper 310 is installed at an end of the ball rail 300 and provides a stop portion for the impact ball 200, thereby limiting the movement distance of the impact ball 200.

Furthermore, the ball rail 300 is made of a non-metallic material, so that it may provide a movement path for the impact ball 200 without reacting with the magnetic force of the magnets 400 to be described later.

The impact ball 200 is a component that provides a weight for the generation of sensations of hitting while being moved by the centrifugal force caused by the swing of the shaft body 100.

More specifically, as shown in FIG. 1, the impact ball 200 is formed as a weight element forming a ring shape, and may be fitted and coupled to be movable along the longitudinal direction of the ball rail 300 formed in the shaft body 100. When the shaft body 100 is swung, the impact ball 200 in the state of being fixed to the magnet fixing part 500 to be described later is moved by a centrifugal force and is stopped by the stopper 310, thereby providing a sensation of hitting.

As shown in FIGS. 1 and 2, the impact ball 200 may include a first impact ball 210, a second impact ball 220, and a ball fixing part 230.

The first impact ball 210 is formed in a ring shape, and may be fixed by a different attractive force depending on the fixed position thereof while being selectively fixed to a first fixing part 510 or a second fixing part 520 constituting the magnet fixing part 500 to be described later through the magnetic force of the magnets 400 to be described later.

The first impact ball 210 is formed in a ring shape, and may be fitted and coupled over the ball rail 300 of the shaft body 100. Fitting slots 211 constituting coupling portions for the magnets 400 to be described later may be formed in the first impact ball 210.

In addition, the first impact ball 210 may be made of a non-metallic material, or otherwise, may be made of a metallic material.

In this case, the fitting slots 211 formed in the first impact ball 210 may be formed along the inner circumference of the first impact ball 210 while forming a plurality of slots and also forming a radial arrangement, as shown in FIG. 3. The fitting slots 211 may provide coupling portions for the magnets 400 through the configuration of exposure openings 211*a* and holding recesses 211*b*.

More specifically, the exposure openings 211*a* may receive the magnets 400 by being formed as openings that are depressed in the longitudinal direction of the first impact ball 210. The exposure openings 211*a* are opened toward the inner surface of the first impact ball 210 and allow the magnets 400 to face the first fixing part 510 or the second fixing part 520 to be described later, thereby fixing the first impact ball 210 to the first fixing part 510 or the second fixing part 520.

Furthermore, the holding recesses 211*b* may be formed as recesses each having a stepped cross section on one side of each of the above-described exposure recesses 211*a*, thereby providing holding portions for the magnets 400.

The second impact ball 220 is a component that increases the weight of the first impact ball 210 by being coupled to the first impact ball 210 through the ball fixing part 230 to be described later.

Unlike the first impact ball 210, which may be selectively fixed to the first fixing part 510 or the second fixing part 520, this impact ball 220 is a component that is fixed only to the first fixing part 510 through the magnetic force of the magnets 400.

More specifically, the second impact ball 220 is formed in a ring shape having a weight different from that of the first impact ball 210, and may be fitted and coupled over the ball rail 300 of the shaft body 100. Fitting slots 221 forming coupling portions for magnets 400 to be described later may be formed in the second impact ball 220.

In addition, the second impact ball 220 may be made of a non-metallic material, or otherwise, may be made of a metallic material.

In this case, the fitting slots 221 formed in the second impact ball 220 may be formed along the inner circumference of the second impact ball 220 while forming a plurality of slots and also forming a radial arrangement, as shown in FIG. 4. In the same manner as the fitting slots 211 of the first impact ball 210 described above, the fitting slots 221 may provide coupling portions for the magnets 400 through the configuration of exposure openings 221*a* and holding recesses 221*b*.

In this case, the second impact ball 220 may be formed to have a smaller inner diameter than the first impact ball 210, as shown in FIG. 5. Accordingly, the magnets 400 coupled into the fitting slots 221 may be spaced apart from the first fixing part 510 at a shorter interval than the magnets 400 of the impact ball 210.

The ball fixing part 230 is a component that couples and fixes the first impact ball 210 and the second impact ball 220 to each other.

As shown in FIG. 2, the ball fixing part 230 may be configured to include a buffer plate 231, centering protrusions 232, centering depressions 233, and fastening bolts 234.

The buffer plate 231 buffers the impact applied to a contact area and also seals the contact area while being fixed in a state of being interposed between the first impact ball 210 and the second impact ball 220.

The centering protrusions 232 form male members for coupling the first impact ball 210 and the second impact ball 220 to each other. The centering protrusions 232 may protrude from any one of the first impact ball 210 and the second impact ball 220 while forming a plurality of protrusions, and may pass through the buffer plate 231.

The centering depressions 233 form female members for coupling the first impact ball 210 and the second impact ball 220 to each other. The centering depressions 233 may be formed in the other one of the first impact ball 210 and the second impact ball 220 as a plurality of depressions, and may be fitted over the centering protrusions 232.

Accordingly, the first impact ball 210 and the second impact ball 220 may be prevented from being freely rotated in the circumferential direction by the combination of the centering protrusions 232 and the centering depressions 233.

The fastening bolts 234 may fix the first impact ball 210 and the second impact ball 220 in a coupled state by fastening the first impact ball 210, the buffer plate 231, and the second impact ball 220 therethrough.

The magnets 400 provide magnetic force for fixing the impact ball 200 to one end of the above-described ball rail 300. The magnets 400 may include one or more magnets, and may be installed in each of the first impact ball 210 and the second impact ball 220 constituting the above-described impact ball 200.

As shown in FIG. 5, the magnets 400 may be configured to include at least one first magnet 410 installed in the first impact ball 210 and at least one second magnet 420 installed in the second impact ball 220.

More specifically, the first magnet 410 may be coupled into at least one of the fitting slots 211 provided in the first impact ball 210. The first magnet 410 may face the ball rail 300 and the magnet fixing part 500 to be described later at a predetermined interval while being exposed to the inner surface of the first impact ball 210 through the exposure opening 211*a* constituting a part of the fitting slot 211.

In this case, the first magnet 410 may be formed of a plurality of magnets, and the plurality of magnets may be installed in the respective fitting slots 211.

The second magnet 420 may be coupled into at least one of the fitting slots 221 provided in the second impact ball 220. The second magnet 420 may face the ball rail 300 and the magnet fixing part 500 to be described later at a predetermined interval while being exposed to the inner surface of the second impact ball 220 through the exposure opening 221*a* constituting a part of the fitting slot 221.

In this case, the second magnet 420 may be coupled into only one of the plurality of fitting slots 221, and weight blocks 240 having the same weight and shape as the second magnet 420 may be coupled into the remaining fitting slots 221, as shown in FIG. 4.

It is obvious that second magnets 420 may be coupled into all the plurality of fitting slots 221, respectively.

Meanwhile, the above-described first magnet 410 may be coupled into only one of the plurality of fitting slots 211, and weight blocks (not shown) having the same weight and shape as the first magnet 410 may be coupled into the remaining fitting slots 211.

In addition, a pair of first magnets 410 or second magnets 420 may be coupled into a pair of facing fitting slots 211 or 212 among the plurality of fitting slots 211 or 212, and a pair of weight blocks may be coupled into the remaining fitting slots 211.

In this case, the second magnet 420 may be spaced apart from the ball rail 300 and the first fixing part 510 at a shorter interval than the first magnet 410 as the inner diameter of the second impact ball 220 is formed to be smaller than the inner diameter of the first impact ball 210. The second magnet 420 may provide a stronger magnetic force to the ball rail 300 and the first fixing part 510 than the first magnet 410.

The magnet fixing part 500 is a component for providing a variety of sensations of weight during swing practice by holding the impact ball 200 to the upper one of both ends of the ball rail 300 in the longitudinal direction, i.e., the end of the ball rail 300 opposite to the stopper 310, through the action of attraction with the magnets 400 installed in the impact ball 200 and providing an attractive force having a different strength depending on the position of the impact ball 200.

More specifically, the magnet fixing part 500 may hold the first impact ball 210 and the second impact ball 220 through the action of attraction by facing the first magnet 410 and the second magnet 420 described above while forming a metal region 500*a* made of a metallic material in a part of the upper end of the ball rail 300. The magnet fixing part 500 may be formed to have different outer diameters, so that it may hold the impact ball 200 by an attractive force having a different strength depending on the position through an attractive force acting at a different strength depending on the outer diameter.

The magnet fixing part 500 may be configured to include the first fixing part 510 and the second fixing part 520, as shown in FIGS. 5 to 7.

The first fixing part 510 is a component for holding the impact ball 200 by a weaker attractive force.

More specifically, the first fixing part 510 is formed to have the same outer diameter as the ball rail 300 while forming a part of the metal region 500*a* on the ball rail (300) side, and is formed to have a smaller outer diameter than the second fixing part 520 to be described later and is thus spaced apart from the magnets 400 at a longer interval than the second fixing part 520. Accordingly, the first fixing part 510 may hold the impact ball 200 by a weaker force than the second fixing part 520.

The second fixing part 520 is a component for holding the impact ball 200 by a stronger attractive force.

More specifically, the second fixing part 520 is formed to have a larger outer diameter than the first fixing part 510 while forming the remaining part of the metal region 500*a* on the side opposite to the ball rail 300, and is thus spaced apart from the magnets 400 at a shorter interval than the first fixing part 510. Accordingly, the second fixing part 520 may hold the impact ball 200 by a weaker force than the first fixing part 510.

In other words, as shown in FIGS. 5 and 6, when the first impact ball 210 is located around the first fixing part 510, the first magnet 410 is spaced apart from the first fixing part 510 at a longer interval, so that the first impact ball 210 may be held by a weaker attractive force.

In addition, as shown in FIG. 7, when the first impact ball 210 is located around the second fixing part 520, the first magnet 410 is spaced apart from the second fixing part 520 at a shorter interval, so that that the first impact ball 210 may be held by a stronger attractive force.

Meanwhile, the above-described second impact ball 220 may be formed to have an inner diameter smaller than the outer diameter of the second fixing part 520 while being formed to have an inner diameter smaller than the inner diameter of the first impact ball 210.

Accordingly, the second impact ball 220 may be held only to the first fixing part 510 through the second magnet 420 while being prevented from moving to the second fixing part 520, and may be held to the first fixing part 510 by a stronger attractive force than the first impact ball 210 because the second magnet 420 is spaced apart from the first fixing part 510 at a shorter interval than the first magnet 410.

In summary, the impact ball 200 may be held to the magnet fixing part 500 by attractive forces having three levels of strength, as shown in FIGS. 5 to 7.

Referring to FIG. 5, when the impact ball 200 is located around the first fixing part 510 only through the first impact ball 210, it is held to the first fixing part 510 only through the first magnet 410, so that it may be held by an attractive force having the weakest one of the three levels of strength.

Therefore, when the shaft body 100 is swung, the impact ball 200 may be moved toward the stopper 310 while being separated from the magnet fixing part 500 even by a weaker centrifugal force, thereby providing a sensation of hitting.

Referring to FIG. 6, when the impact ball 200 is located around the first fixing part 510 through the first impact ball 210 and the second impact ball, it may be held to the first fixing part 510 through the first magnet 410 and the second magnet 420 and also be held by an attractive force having the intermediate one of the three levels of strength because the first magnet 410 is spaced apart from the first fixing part 510 at a longer interval.

Referring to FIG. 7, when the impact ball 200 is located around the second fixing part 520 through the first impact ball 210 and is also located around the first fixing part 510 through the second impact ball, it is spaced apart from the second fixing part 520 at a shorter interval through the first magnet 410 and is also spaced apart from the first fixing part 510 at a shorter interval through the second magnet 420, so that it may be held by an attractive force having the strongest one of the three levels of strength.

Accordingly, when the shaft body 100 is swung, the impact ball 200 may be moved toward the stopper 310 while being separated from the magnet fixing part 500 only by a stronger centrifugal force, thereby providing a sensation of hitting.

Meanwhile, the golf swing training apparatus 10 according to an embodiment may be configured to further include an IR light emitter 600, as shown in FIG. 1.

The IR light emitter 600 is a component that emits infrared rays for tracking the movement of the shaft body 100 by a sensor (not shown).

The IR light emitter 600 may be installed at the front end of the shaft body 100 or on at least one of the impact ball 200, the ball rail 300, and the stopper 310, and may emit infrared rays. Data for tracking the movement of the shaft body 100 may be provided to a server (not shown) by being detected through a sensor (not shown).

Accordingly, the server may detect the movement or movement trajectory of the shaft body 100 via the IR light emitter 600 detected through the sensor, and may obtain, provide, and store various types of data such as the number of times, trajectories, accuracy, and/or the like according to the practice of the swing of the shaft body based on the detected IR light emitter 600.

A method of using the golf swing training apparatus 10 including the above-described components according to an embodiment will be described.

The impact ball 200 may be fixed at a predetermined position of the magnet fixing part 500 through the magnetic force of the magnets 400 while being moved by a user.

In this case, the impact ball 200 is fixed in a state of being located around the first fixing part 510 only through the first impact ball 210 and the first magnet 410, so that it may provide the center of gravity toward the lower part of the shaft body 100 while being fixed by the weakest attractive force.

Unlike this, the impact ball 200 is fixed in a state of being located around the first fixing part 510 through the first impact ball 210 and the second impact ball 220, so that it may be fixed by an intermediate-level attractive force.

Unlike these, the impact ball 200 is fixed while being located around the second fixing part 520 and the first fixing part 510 through the first impact ball 210 and the second impact ball 220, respectively, so that it may provide the center of gravity toward the grip of the shaft body 100 while being fixed by the strongest attractive force.

The shaft body 100 is swung while being held by a user through the grip 110.

In this case, the impact ball 200 is separated from the magnet fixing part 500 by the centrifugal force caused by the swing of the shaft body 100, moves along the ball rail 300, and hits the stopper 310, thereby providing a sensation of hitting.

In this case, when the impact ball 200 is fixed by a weaker attractive force, it may be separated from the magnet fixing part 500 even by a weaker centrifugal force. In contrast, when the impact ball 200 is fixed by a stronger attractive force, it may be separated from the magnet fixing part 500 only when a stronger centrifugal force is applied. Accordingly, it may be possible to adjust the strength of swing practice.

As described above, according to the golf swing training apparatus 10 according to the embodiment, the strength of the attractive force attributable to the magnetic force may be adjusted by adjusting the initial position of the impact ball 200 while the impact ball 200, which provides a sensation of hitting via weight while being moved by the centrifugal force caused by a swing, is fixed to the metal region 500*a* formed on the ball rail 300 through the magnetic force of the magnets 400, thereby providing a variety of sensations of weight during swing practice.

The above-described embodiments are intended for illustrative purposes. It will be understood that those of ordinary skill in the art to which the present invention pertains can easily make modifications and variations without changing the technical spirit and essential features of the present invention. Therefore, the above-described embodiments are illustrative and are not limitative in all aspects. For example, each component described as being in a single form may be practiced in a distributed form. In the same manner, components described as being in a distributed form may be practiced in an integrated form.

The scope of protection pursued via the present specification should be defined by the attached claims, rather than the detailed description. All modifications and variations which can be derived from the meanings, scopes and equivalents of the claims should be construed as falling within the scope of the present invention.

The invention claimed is:

1. A golf swing training apparatus for providing sensations of hitting for golf swing practice, the golf swing training apparatus comprising:

a shaft body formed to a predetermined length, and having a grip formed at one of both ends thereof in a longitudinal direction thereof;

an impact ball coupled to be movable along the longitudinal direction of the shaft body, and configured to provide weight for generation of a sensation of hitting while being moved in a direction opposite to that of the grip by a centrifugal force caused by a swing of the shaft body;

a ball rail formed in a part of the shaft body opposite to the grip along the longitudinal direction, configured to provide a movement path for the impact ball, and provided with a stopper at an end thereof to provide a stop portion for the impact ball;

one or more magnets installed in the impact ball, and configured to provide a magnetic force; and a magnet fixing part configured to face the magnets while forming a metal region made of a metallic material in a portion of one of both ends of the ball rail opposite to the stopper in the longitudinal direction, and also configured to hold the impact ball through an action of attraction with the magnets and to provide an attractive force having a different strength depending on a position of the impact ball, wherein the magnet fixing part comprises:

a first fixing part configured to form a portion of the metal region on a ball rail side, to be formed to have a same outer diameter as the ball rail, and to hold the impact ball by a weaker attractive force while being spaced apart from the magnets at a longer interval; and a second fixing part configured to forming a remaining portion of the metal region on a grip side, to be formed to have a larger outer diameter than the first fixing part, and to hold the impact ball by a stronger attractive force while being spaced apart from the magnets at a shorter interval.

2. The golf swing training apparatus of claim 1, wherein:

the impact ball comprises a first impact ball formed in a ring shape having an inner diameter larger than an outer diameter of the second fixing part and configured such that recess-shaped fitting slots providing coupling portions for the magnets are formed in a radial arrangement along an inner circumference thereof so that the first impact ball is held to the second fixing part or the first fixing part by the magnets; and the magnets comprise a first magnet coupled into at least one of the fitting slots of the first impact ball and spaced apart from the first fixing part or the second fixing part at a predetermined interval while being exposed to an inner surface of the first impact ball.

3. The golf swing training apparatus of claim 2, wherein each of the fitting slots comprises:

an exposure opening formed as an opening depressed in a longitudinal direction of the first impact ball, and configured to accommodate the first magnet and to be opened toward the inner surface of the first impact ball and allow the first magnet to face the first fixing part or the second fixing part; and a holding recess formed as a recess having a stepped cross section on one side of the exposure opening, and configured to provide a holding portion for a part of the first magnet.

4. The golf swing training apparatus of claim 2, wherein: the impact ball further comprises:

a second impact ball formed in a ring shape having an inner diameter larger than the outer diameter of the first fixing part and smaller than the outer diameter of the second fixing part, configured to move together with the first impact ball while being coupled to the first impact ball, and also configured such that recess-shaped fitting slots providing coupling portions for the magnets are formed in a radial arrangement so that the second impact ball is held to the first fixing part by the magnet; and a ball fixing part configured to fix the second impact ball to the first impact ball; and the magnets further comprise a second magnet coupled into at least one of the fitting slots of the second impact ball and spaced apart from the first fixing part at a predetermined interval while being exposed to an inner surface of the second impact ball.

5. The golf swing training apparatus of claim 4, wherein the second magnet is spaced apart from the first fixing part at a shorter interval than the first magnet coupled into the first impact ball.

6. The golf swing training apparatus of claim 4, wherein the second magnet is coupled into one of the fitting slots of the second impact ball.

7. The golf swing training apparatus of claim 6, further comprising a weight block configured to provide a weight corresponding to the second magnet while being coupled into a remaining one of the fitting slots of the second impact ball.

8. The golf swing training apparatus of claim 4, wherein the ball fixing part comprises:

a buffer plate configured to be fixed in a state of being interposed between the first impact ball and the second impact ball;

a centering protrusion protruding from one of the first impact ball and the second impact ball, and configured to pass through the buffer plate;

a centering depression formed in a depression form in a remaining one of the first impact ball and the second impact ball, and configured to receive the centering protrusion; and a fastening bolt configured to be fastened through the first impact ball, the buffer plate, and the second impact ball.

9. The golf swing training apparatus of claim 4, wherein the second impact ball has a different weight from that of the first impact ball.

10. The golf swing training apparatus of claim 1, further comprising an IR light emitter configured to be installed on at least one of the shaft body, the impact ball, the ball rail, and the stopper and to emit infrared rays for tracking of movement of the shaft body.

* * * * *